United States Patent [19]

Snowdon et al.

[11] Patent Number: 4,462,657

[45] Date of Patent: Jul. 31, 1984

[54] COMPLIANT ELECTRICAL CONNECTOR FOR FLAT CONDUCTORS

[75] Inventors: Albert C. Snowdon, Shorewood; Kenneth A. Forsell, Brown Deer; Peter J. Theisen, West Bend; Emil W. Zarling, Muskego; David G. Porter, East Troy, all of Wis.

[73] Assignee: Eaton Corporation, Cleveland, Ohio

[21] Appl. No.: 384,838

[22] Filed: Jun. 4, 1982

Related U.S. Application Data

[63] Continuation-in-part of Ser. No. 141,443, Apr. 18, 1980, abandoned.

[51] Int. Cl.[3] ..... H01R 13/187

[52] U.S. Cl. ..... 339/256 S; 339/278 C

[58] Field of Search ..... 339/176 R, 176 M, 176 MP, 339/252 R, 252 P, 252 S, 278 C, 256 R, 256 RT, 256 S, 198 G, 22 R, 22 B, 194 R, 19; 200/144 R, 200 AP, 258, 267, 276

[56] References Cited

U.S. PATENT DOCUMENTS

| | | | |
|---|---|---|---|
| 959,435 | 5/1910 | Thomson | 200/159 R |
| 2,882,514 | 4/1959 | Krantz | 339/256 S |
| 2,965,734 | 12/1960 | Timmerman | 200/144 R |
| 2,975,254 | 3/1961 | Yanagisawa | 200/144 R |
| 3,087,038 | 4/1963 | Bethke | 200/237 |
| 3,127,492 | 3/1964 | Date | 200/258 |
| 3,567,892 | 3/1971 | Boersma et al. | 200/258 |
| 3,571,547 | 3/1971 | Boersma et al. | 200/258 |
| 3,975,079 | 8/1976 | Blakesley et al. | 339/278 C |
| 4,033,654 | 7/1977 | Ross | 339/143 R |
| 4,174,143 | 11/1979 | Hicks, Jr. et al. | 339/22 B |

FOREIGN PATENT DOCUMENTS

| | | | |
|---|---|---|---|
| 1440782 | 12/1968 | Fed. Rep. of Germany | 339/256 S |
| 29822 | of 1914 | United Kingdom | 339/256 S |
| 1542102 | 3/1979 | United Kingdom | 339/256 S |

*Primary Examiner*—Neil Abrams

*Attorney, Agent, or Firm*—C. H. Grace; L. G. Vande Zande

[57] ABSTRACT

A plurality of coil springs (6) are secured to the flat inner surfaces (4a) of a jaw type connector (12) to receive a flat conductor (20, 24) such as a bus bar between the opposed springs, the individual coils of each spring (6) engaging the surfaces of the connector (4) and bus bar (20, 24) to provide a compliant, multiple path electrical connection between the connector and bus bar. The springs are plated with a material having a low interface resistance (Rp) with respect to the resistance of the spring wire (Rw) to minimize the net change in resistance of any individual current path in the event of contact interface breakdown between a spring coil and bus bar or connector, thereby reducing or eliminating harmful damage to the spring.

5 Claims, 15 Drawing Figures

COMPLIANT ELECTRICAL CONNECTOR FOR FLAT CONDUCTORS

This application is a continuation-in-part of our copending application Ser. No. 141,443 filed Apr. 18, 1980, now abandoned.

BACKGROUND OF THE INVENTION

This invention relates to electrical connectors for flat conductors such as in bus duct joints and bus bar stabs. Presently available commercial designs utilize flat face, heavy pressure connections between such members which require large insertion and removal forces or subsequent torquing of clamping fasteners after insertion. Due to irregularities in all flat surfaces, the actual contact between mating flat surfaces theoretically occurs at three points which define the plane of the surface. Thus, the electrical transfer of current between two flat members is concentrated at these three points, which can produce harmful effects under high short circuit currents.

In bus duct apparatus, a particular problem exists in the alignment of the bus bar ends and the respective connectors. Since the bus bars are quite rigid members, the connectors, which are usually stacked one upon another, must be carefully spaced to accept the bus bars. The common method of making such connection is to leave the stack of connectors loosely assembled to one bus duct section until the adjacent section is positioned in place, and then to tighten the connector to a specific pressure.

SUMMARY OF THE INVENTION

This invention provides an electrical connector for connecting separable, flat, electrically conductive members comprising: at least one electrically conductive coil spring mounted on a flat surface of one of said conductive members, the longitudinal axis of said spring being parallel to said flat surface; and means for positioning a flat surface of the other of said conductive members against said spring in electrical engagement therewith and deflecting the individual coils of said spring from their normal position.

It is an object of this invention to provide a compliant electrical connector which is operable under misalignment conditions of the connector and the conductor to be connected.

It is a further object of this invention to provide a compliant electrical connector which has a low resistive drop and high short circuit capability.

It is a further object of this invention to provide a compliant electrical connector which has a low insertion force.

These and other objects of this invention will become apparent in the following description and claims, when read in conjunction with the drawings.

DESCRIPTION OF THE PREFERRED EMBODIMENT

Figure 1:
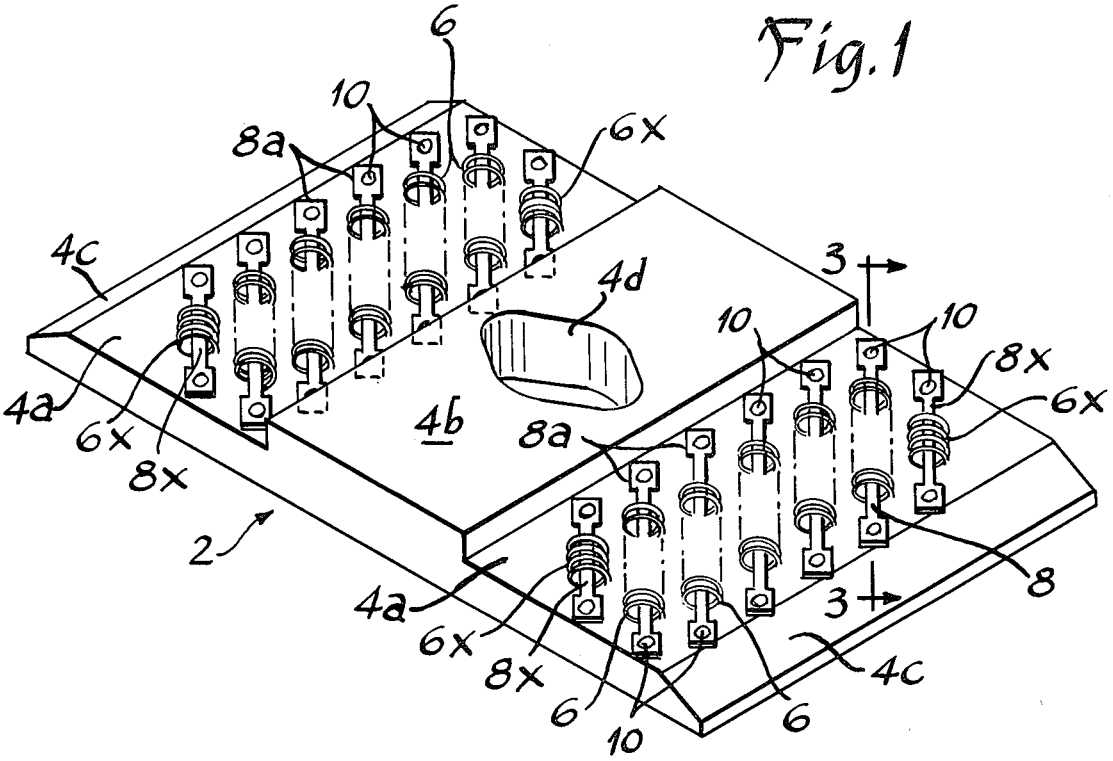
FIG. 1 is an isometric view of an electrically conductive plate assembly having a plurality of coil spring connectors mounted on one face thereof.

A first embodiment of the electrical connector of this invention is shown in FIG. 1 of the drawings and is designated by the general reference character 2. Connector 2 comprises a substantially flat, rectangular plate 4 of copper, aluminum or other electrically conductive material having a primary flat surface 4*a* and a raised central surface 4*B*. The outer ends of plate 4 are beveled outwardly at 4*c* away from the primary surface 4*a*. A centrally located oblong aperture 4*d* extends between raised central surface 4*b* and the opposite surface of plate 4.

Figure 3:
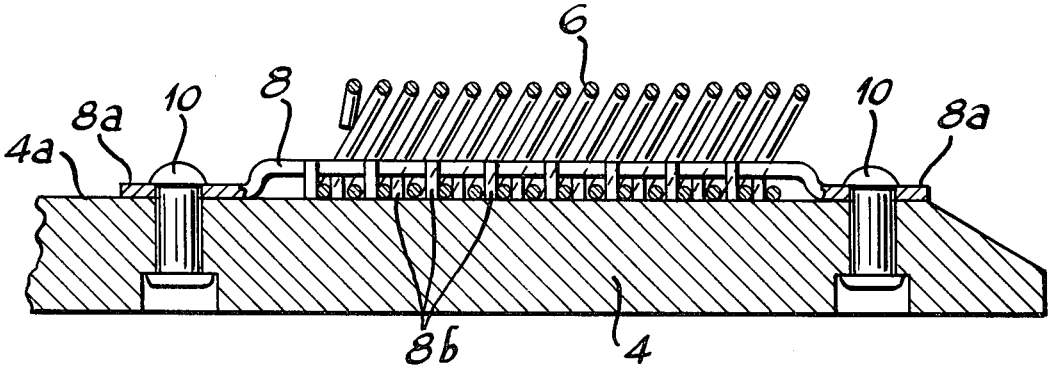
FIG. 3 is a cross sectional view taken along line 3—3 of FIG. 1 and drawn to an enlarged scale.
Figure 5:
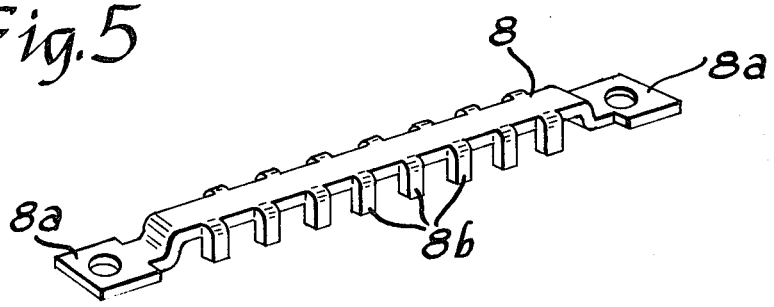
FIG. 5 is an isometric view of a mounting strap for mounting the coil springs to the face of a conductive plate.
Figure 6:
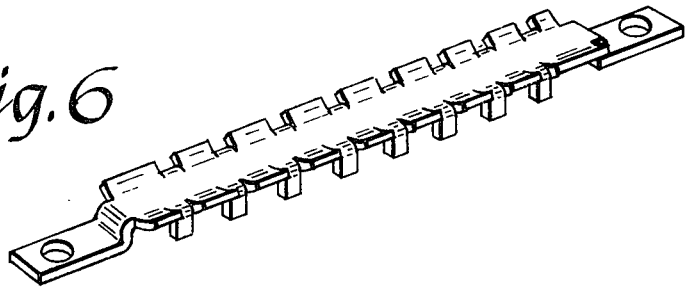
FIG. 6 is an isometric view of an alternative mounting strap.

A plurality of electrically conductive coil springs 6 are mounted to the primary surface 4*a* of plate 4 on either side of the raised central portion. With additional reference to FIGS. 3 and 5, each spring 6 has a mounting strap 8 associated therewith, the strap 8 passing axially through and extending beyond the opposite ends of the spring 6. Each end of strap 8 is offset downwardly to provide foot portions 8*a* which have central apertures for receiving a rivet 10 which also passes through an aligned, counterbored hole in plate 4 to secure the strap 8 to the surface 4*a*. Strap 8 further has a plurality of downwardly formed lateral tabs 8*a* along its opposite edges which receive individual coils of the spring 6 therebetween to fix the position of each coil with respect to axial movement along the surface 4*a*. The main body portion of strap 8 may be formed flat or transversely arcuate as shown in FIG. 6, wherein the arcuate shape conforms to the inner diameter of the spring to more rigidly position the lower portion of the spring.

As best seen in FIG. 1, the coil springs 6 are mounted at an oblique angle with respect to the longitudinal and lateral dimensions of plate 4. The angular positioning of the springs facilitates insertion of conductors into a completed connector assembly in either the longitudinal or lateral direction. To optimize the number of coils per area of surface 4*a*, shorter springs 6*x* and straps 8*x* are provided at each corner of the surface 4*a*, the springs 6*x* and straps 8*x* being otherwise identical to the aforedescribed springs 6 and straps 8.

Figure 2:
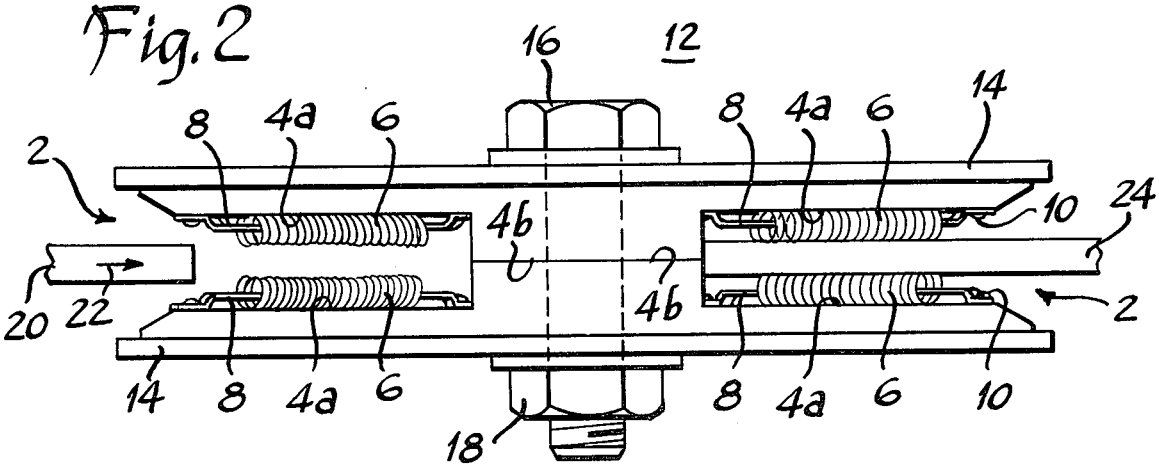
FIG. 2 is a side elevation view of a connector assembly comprising two of the plate assemblies of FIG. 1 mounted in face-to-face relationship and showing electrical conductors inserted and positioned to be inserted therein.

A preferred connector assembly 12 suitable for electrically interconnecting two aligned, flat conductors is shown in FIG. 2. The connector assembly comprises two of the connectors 2 of FIG. 1 mounted in face-to-face arrangement with the raised central surfaces 4*b* abutting. A pair of rectangular insulators 14 are positioned adjacent the outer surfaces of plates 4, the insulators 14 being provided with central apertures similar to apertures 4*d*. The assembly is secured together by a bolt 16 which passes through the plates 4 and insulators 14 and receives a nut 18 at the opposite end. Bolt 16 may be electrically insulated from plates 4 by an insulating sleeve (not shown) disposed therearound within the aligned apertures. If desired, the insulating sleeve may have an oblong cross sectional shape conforming to the shape of the apertures 4*d* to provide rotational alignment of the plates 4 and insulators 14 during assembly.

As seen in FIG. 2, the aforedescribed assembly provides a double-ended, fixed-jaw connector having the coil springs 6 extending within the jaw openings. The distance which each central surface 4*b* is raised above primary surface 4*a* determines the space between opposed upper and lower coil springs 6. That space is selected to be less than the thickness of the conductor to be received in the connector jaw as may be seen at the left-hand side of FIG. 2 wherein a conductor 20 is in position to be inserted into the connector assembly in the direction of arrow 22. Such insertion will cause the coils of springs 6 to be deflected over until sufficient space is provided for the conductor, as can be seen at the right-hand end of FIG. 2 wherein a conductor 24 is shown inserted within the connector assembly.

The resiliency of the individual coils of each spring 6 provides a light insertion force for the conductors 20 are 24 which have a width substantially equal to the width of plates 4. The amount of interference between the spring spacing and conductor thickness and the resiliency of the individual coils permits a greater misalignment tolerance between the conductors 20 and 24 than is permissible in pressure type connections without adversely effecting the electrical connection. A multiplicity of contact interface points and current carrying paths are afforded in this connector by the individual coils of springs 6 and 6*x*, there being one such path in each half of the individual coils between the tangential points of contact with the conductor and the plate. The total amount of current carried by the conductor is divided essentially equally among the current paths whereby each path carries a small amount of current and provides a small voltage drop across that path. The conductor can therefor withstand higher short circuit currents than connectors in which the total current is concentrated in two or three current paths since the shared $I^2t$ value is any one of the multiple current paths is accordingly small. Good contact pressure is maintained throughout the connector by virtue of the individual bias of the coils which engage the conductors and plates without effecting the bias of adjacent coils, individually compensating for minor surface irregularities in the flat members.

Figure 4:
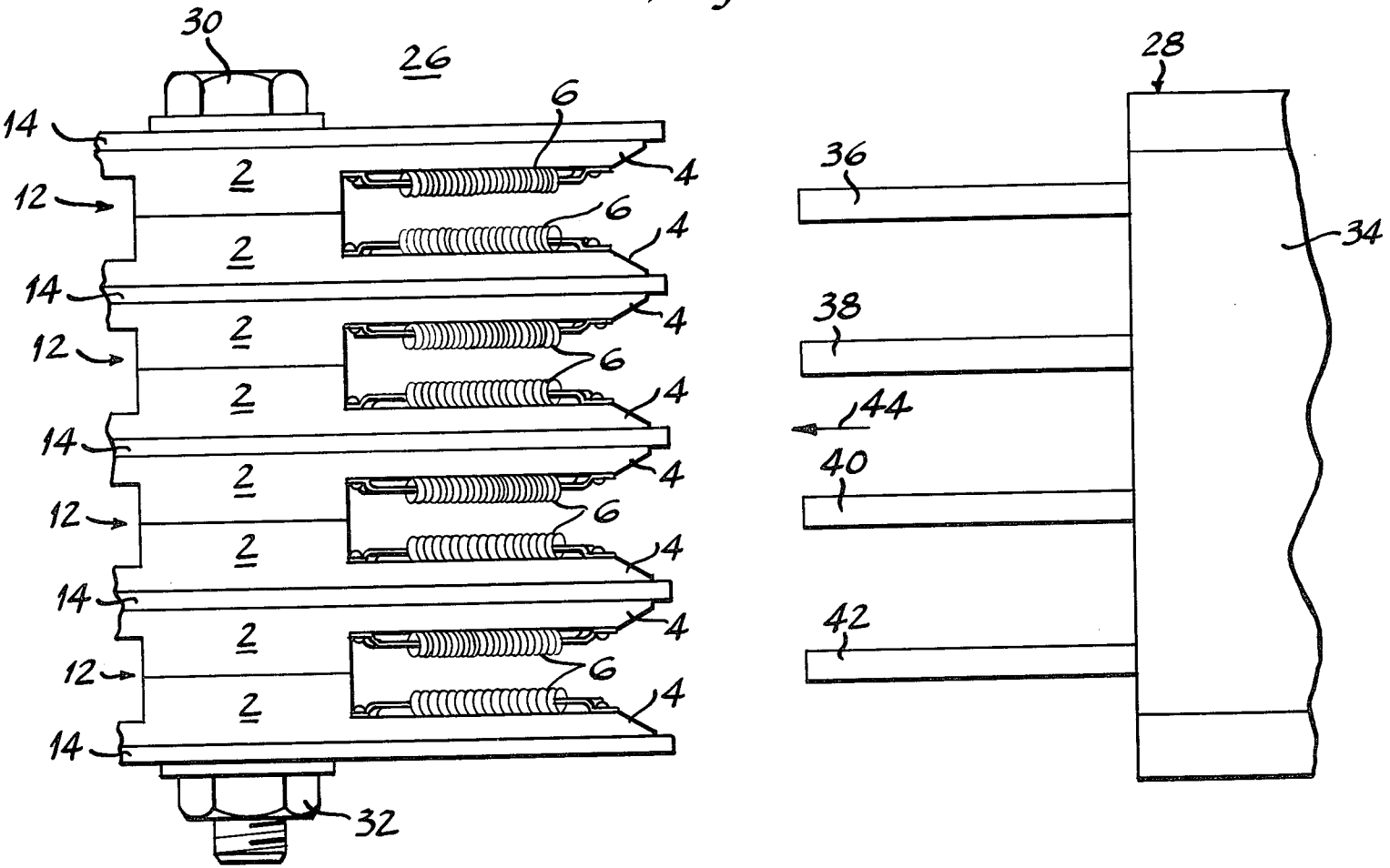
FIG. 4 is a view of a bus duct joint connector made in accordance with this invention, and showing an end of a bus duct section in position for insertion into the joint.

Connector assembly 12 is of the type which may be used to interconnect lengths of bus bars such as may be encased to form a bus duct section. A bus duct joint 26 embodying a stack of four connector assemblies 12 is shown in FIG. 4, the left-hand ends of the connector assemblies being omitted for simplification of the drawings. Also shown in FIG. 4 is an end portion of a bus duct section 28, positioned for insertion into the joint 26.

The joint 26 has insulators 14 at its opposite exterior surfaces similar to the connector assembly 12 of FIG. 2, and has three additional insulators 14 positioned between adjacent assemblies 12 to electrically isolate each connector assembly 12. A bolt 30 extends through the complete stack of four connector assemblies 12 to receive a nut 32 at its opposite end. As before, an insulating sleeve (not shown) may be disposed around bolt 30 to isolate the bolt from the connector assemblies.

Bus duct section 28 comprises a metallic housing 34 which encases bus bars 36, 38, 40 and 42. In certain applications only three bus bars are used, in which case bus bar 42 would be omitted. To electrically connect the bus duct section 28 to joint 26, that section is moved in the direction of arrow 44 until the individual bus bars 36–42 are fully engaged with the springs 6 of the respective connector assemblies 12 as shown by conductor 24 in previously described FIG. 2. For purposes of this description, it may be assumed that the broken away lefthand portion of joint 26 is attached to another bus duct section, and the corresponding bus bars are therefore electrically connected to bus bars 36–42. Mechanical connections between the housings of the individual bus ducts may subsequently be made such as by bolting cover plates (not shown) therebetween which would span the joint 26.

The compliancy of springs 6 provides a specific advantage in bus duct joint connections wherein the spacing between the bus bars to be received by the joint may vary within relatively large tolerances. By providing a joint connector having high compliability, the tolerances in manufacturing the bus duct sections may be relaxed, thereby affording a cost advantage in such manufacturing process.

To enhance the quality of the electrical connection and to reduce the effects of possible resistance breakdowns during use, particular attention is given to the construction of springs 6. In a preferred embodiment, the spring is formed of a nickel copper alloy and is plated with a good contact interface material such as silver. The materials for the spring wire and its plating are selected to have a specific relationship between the interface resistance afforded by the plating material with the conductor surface and the resistance of the main current carrying path spring wire. The relationship is such that a partial or complete breakdown of the interface resistance has a minimal effect on the total resistance for the current path and therefore changes the current value in that path only a small amount.

Figure 7:
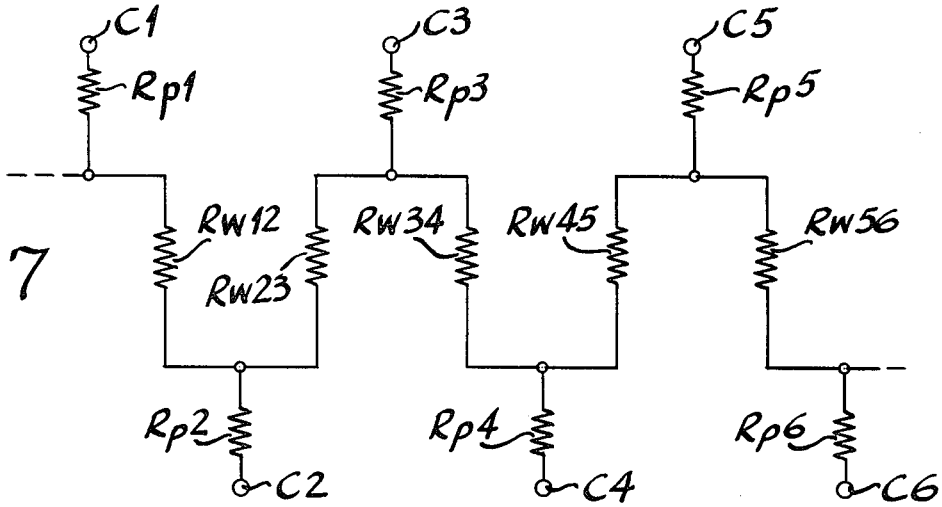
FIG. 7 is a diagrammatic representation of resistance to be considered in the coil spring connectors.

With reference to FIG. 7, the various resistances are schematically depicted for several loops of a coil spring 6. The resistance of each half loop of the metal alloy wire is represented by resistances Rw12, Rw23, Rw34, Rw45 and Rw56 whereas the interface resistance at each point of contact with a conductor or connector plate is represented by Rp1, Rp2, Rp3, Rp4, Rp5 and Rp6. The terminals C1–C6 represent contact interface points of the spring with the respective plates or conductors. It can be seen that the total resistance for any half-loop current path is 2Rp+Rw.

For illustration purposes, the contact point C3 and the associated half-loop current carrying paths C3-C2 and C3-C4 will be considered. The resistance in path C3-C2 is Rp3+Rw23+Rp2; the resistance in path C3-C4 is Rp3+Rw34+Rp4. A breakdown in interface resistance Rp3 could occur, for example, if the plating material began to soften under the heat generated by the current. The conduction spot between spring 6 and the conductor or connector plate at point C3 would widen, thereby reducing the resistance Rp3. A reduction in resistance causes more current to flow in that path which in turn causes greater heating and a further decrease in interface resistance Rp3 until the interface changes to a point where resistance Rp3 is reduced significantly. The total resistance for each path declines accordingly until the final values become essentially Rw23+Rp2 and Rw34+Rp4, respectively. Further increases in current and heating can result in a weakening of the wire loop at contact point C3 producing an open circuit thereat. As this condition materializes, the adjacent current carrying half-loops C2-C1 and C4-C5 assume a larger portion of current to compensate for the current no longer carried by the open circuited paths C3-C2 and C3-C4. It will be appreciated that this condition can spread in both directions, leading to a breakdown of the complete spring.

To avoid the aforementioned problems, or to lessen the damaging effects thereof, the ratio between wire path resistance R2 and interface resistance Rp, considering only a single interface, is held in a lower limit of $Rw/Rp \geqq 1.0$. Under such conditions, Rp is equal to or a lower value compared to Rw, and a breakdown at one contact interface decreasing or completely removing one of the Rp values changes the total resistivity in that current path only to a minor degree so that the change in current flow in that path increases similarly only a minor amount. As a result, the harmful effects of a contact interface breakdown are minimized.

The following specific equation has been derived for determining the parameters of materials to be used in constructing the coil springs 6:

$$\frac{Rw}{Rp} = \frac{\rho w}{\rho p} \times \frac{D}{d^2} \times \sqrt{F} \times \frac{4}{\sqrt{\pi}\ H}$$

In the above equation:

$\rho w$ = resistivity of the spring wire
$\rho p$ = resistivity of the interface materials
D = Diameter of spring loop in inches
d = diameter of spring wire in inches
F = contact force in pounds
H = Holm contact hardness in psi.

Through proper selection of base spring wire material and plating material such that the above equation solves to a value of 1.0 or greater, contact interface breakdown problems are minimized. The preferred choice of materials is nickel copper alloy wire plated with silver, although other combinations may be used equally as well.

Figure 8:
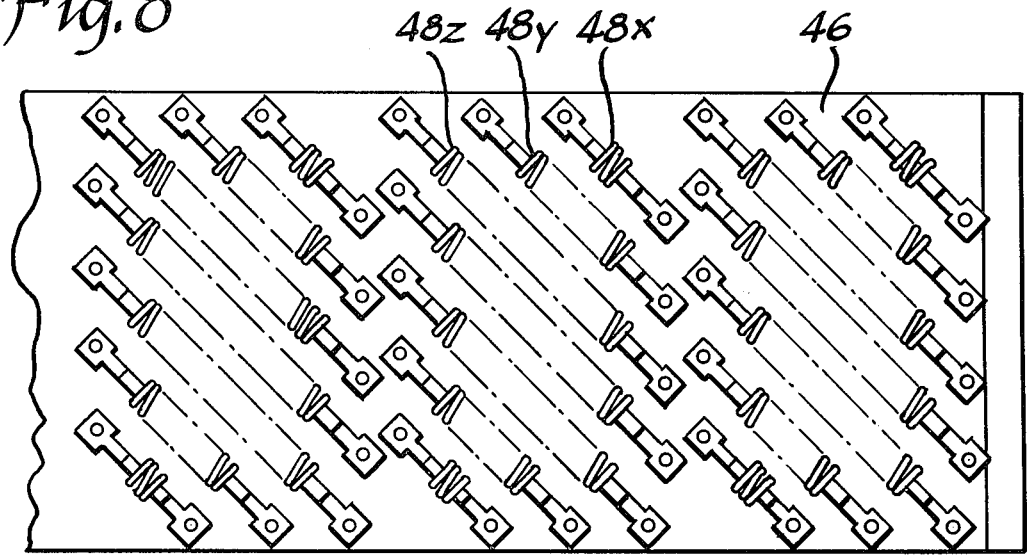
FIG. 8 is a plan view of an elongated conductive plate having a multiplicity of coil spring connectors mounted on one face thereof.

A modification of the electrical connector of this invention is shown in FIG. 8. This embodiment is intended for applications having large current values, and the current density for the connection is increased by increasing the number of coil springs. One end portion of a flat connector plate 46, similar to plate 4, is shown which has three transverse rows of coil springs 48 attached thereto. As in the previous embodiment, maximum use of the plate 46 is made by varying the length of the springs. The corners of each row have short springs 48*x*, while longer springs 48*y* are mounted next adjacent to the springs 48*x* and still longer springs 48*z* are used in the central portion of each row. Other arrangements may be possible, but it should be appreciated that a practical limit to the length of the spring and strap exists for purposes of secure mounting to the plate.

Figure 9:
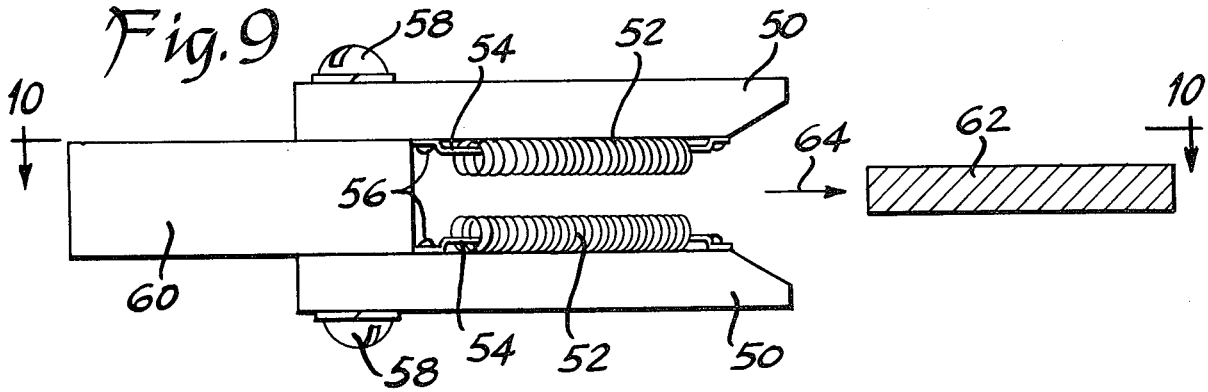
FIG. 9 is a side elevation view of an alternate version of the connector assembly shown in FIG. 2.
Figure 10:
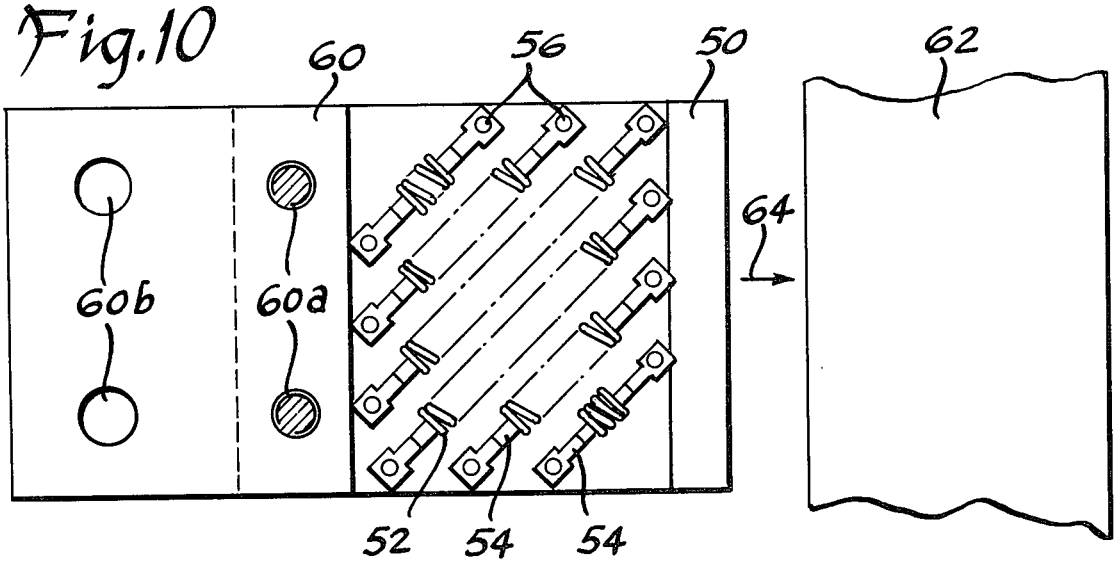
FIG. 10 is a plan view of the connector assembly of FIG. 9 taken along line 10—10 of FIG. 9 showing the top conductor plate removed.

The invention may also be applied to stab-on, or fork connectors for use in panelboard and switchboard applications or the like. One such connector is shown in FIGS. 9 and 10. A pair of electrically conductive plates 50 each have a plurality of coil springs 52 secured thereto by straps 54 and rivets 56 in the same manner as described in connection with double-ended connectors 2. The left-hand ends of connector plates 50 are provided with clearance openings to receive screws 58 which pass therethrough to take into threaded holes 60*a* in a spacer plate 60. The latter has a pair of clearance holes 60*b* at its left-hand end for making bolted connection with load apparatus, flexible conductors or the like. Spacer plate 60 provides the desired space between the upper and lower coil springs 52 which is less than the thickness of a current carrying bus bar 62. As before, the individual coils are deflected over when the connector is moved onto the bus bar in the direction of arrow 64, and point contact is made at the point of tangential contact of each loop of the springs with the respective plate or bus bar.

Figure 11:
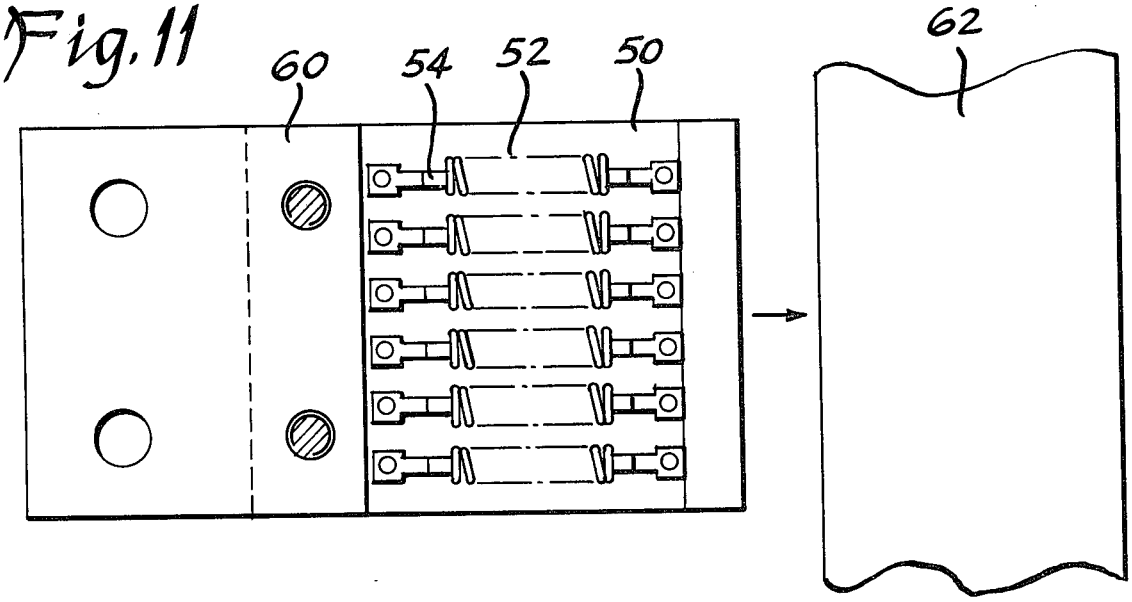
FIG. 11 is a plan view similar to FIG. 10, but showing a modified arrangement of the coil spring connectors.
Figure 12:
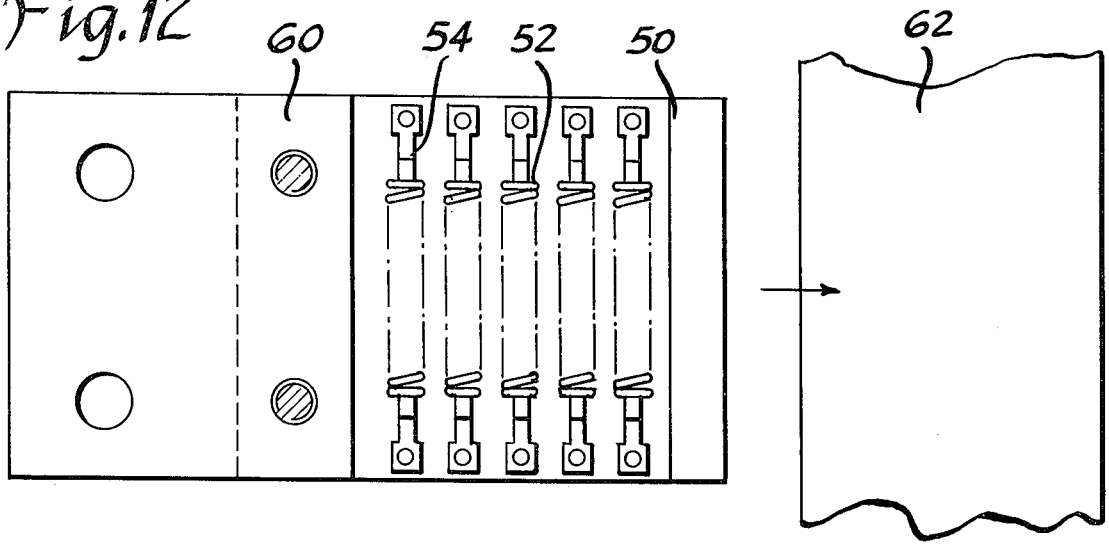
FIG. 12 is a plan view similar to FIGS. 10 and 11, but showing another modified arrangement of the coil spring connectors.

The foregoing embodiments have each disclosed the coil springs to be mounted at an oblique angle to the preferred direction of insertion. By so mounting the springs, the direction of insertion may also be at the right angles to the indicated preferred direction without change to force characteristics of the connector. However, as seen in FIGS. 11 and 12, the springs may alternatively be mounted axially parallel to the direction of insertion or axially transversely to the direction of insertion, respectively. In the former instance, as shown in FIG. 11, the coils of the springs lie at substantially right angles to the direction of attachment to the bus bar and are easily and directly deflected, thereby lowering the force required to attach the connector to the bus bar. In the latter instance, shown in FIG. 12, the coils are generally parallel with the direction of attachment to the bus bar, and a greater force is required to deflect the coils from their initial position.

Figure 13:
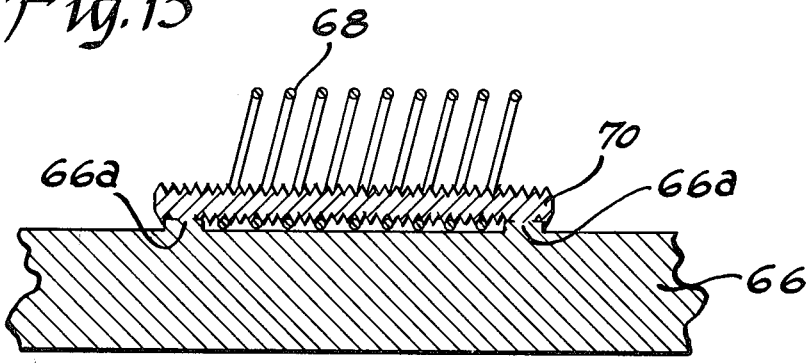
FIG. 13 is a cross sectional view similar to FIG. 3, but showing a modified mounting arrangement for the coil spring connector.
Figure 14:
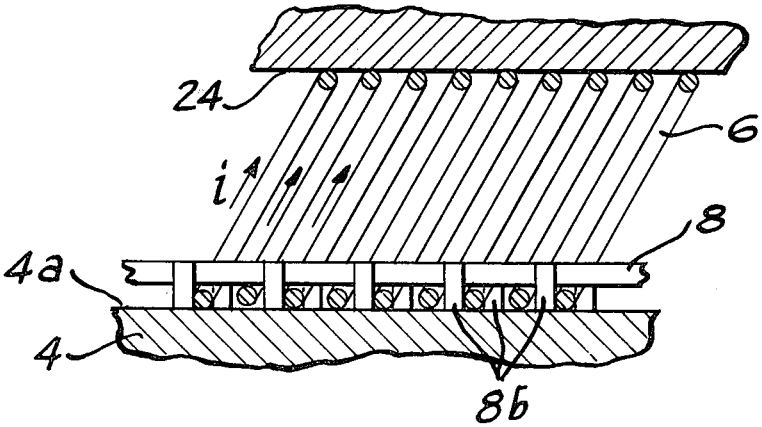
FIG. 14 is an enlarged cross sectional view, similar to FIG. 3, but including the lower portion of a mating conductor member.

FIG. 13 shows an alternate method of mounting the springs to a conductive plate. A portion of a plate 66 is shown to have two upstanding bosses 66*a* formed on the surface, between which a spring 68 is positioned. A threaded rod 70 is inserted axially through the spring 68, the ends of rod 70 projecting beyond the spring and resting upon the bosses 66*a*. The rod 70 is preferrably secured to bosses 66*a* by welding. The lower portions of the spring loops are trapped against the surface of plate 66 by the threaded rod, the threads serving to fix the position of the loops axially along that surface.

The compliant connector described herein is particularly advantageous under high current short circuit conditions. One reason is that the current is split into a number of smaller, substantially equal portions of the whole, which individually have less effect on the spring than if the total current was concentrated in one member. Another reason is that one end of each loop of the spring is fixed against axial movement along the conductor or plate, either by the lateral tabs of strap 8 or by the threads of rod 70. In this regard, it must be noted that the current in adjacent half-loops of the spring flows in the same, parallel direction and that such currents generate attractive electromagnetic forces. The net result is to cause the spring to contract, but since one end of each loop is fixed against axial movement, the net effect is to cause the other end to pivot and wedge itsefl more tightly between the conductor and plate.

Figure 15:
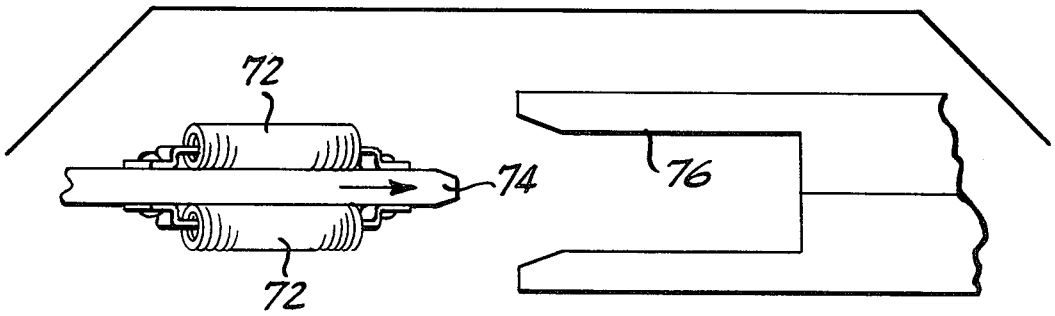
FIG. 15 is a side elevational view of another modified embodiment of the connector of this invention.

Various modifications of the connector assemblies shown herein are deemed to be within the scope of the invention. Although not specifically shown in the drawings, the connector may embody springs mounted to engage only one surface of a conductor with a cooperating member engaging the opposite surface of the conductor to establish a predetermined interference space for reception of the conductor. Another form of modification is shown in FIG. 15 wherein the springs 72 are mounted on the conductor 74 which is received by a fork type connector 76. Alternatively, conductor 74 could cooperatively engage directly with another conductor which does not have springs mounted thereon, but which is provided with a suitable means for establishing an interference relationship between the two conductors for causing the spring coils to deflect. Thus, while the apparatus hereinbefore described is effectively adapted to fulfill the objects stated, it is to be understood that the invention is not intended to be confined to the particular embodiments of compliant electrical connector disclosed, inasmuch as it is susceptible of various modifications without departing from the scope of the appended claims.

We claim:

1. An electrical connector for connecting separable, flat, electrically conductive members comprising:

at least one electrically conductive coil spring mounted on a flat surface of one of said conductive members, the longitudinal axis of said spring being parallel to said flat surface; and means for positioning a flat surface of the other of said conductive members against said spring in electrical engagement therewith and deflecting the individual coils of said spring from their normal position;

said coil spring being mounted on said flat surface by an elongated mounting member which passes axially through said coil spring to extend beyond said spring at opposite ends thereof, the opposite ends of said mounting member being secured to said one of said conductive members, said mounting member having formations along its length for receiving the individual coils of said spring for restraining said individual coils against movement along said flat surface in the axial direction of said spring.

2. The electrical connector according to claim 1 wherein said formations comprise lateral tabs formed downwardly from each longitudinal edge of said mounting member and the opposite ends of said mounting member are offset downwardly to provide foot portions substantially co-planar with the free ends of said downwardly formed tabs.

3. The electrical connector according to claim 2 wherein the portion of said mounting member within said spring has an arcuate transverse cross sectional shape conforming to the inner diameter of said spring, the outer edges of which flare upwardly and the center of which is raised from the plane of said foot portions and the free ends of said downwardly formed tabs.

4. The electrical connector according to claim 2 wherein the portion of said mounting member within said spring has a flat transverse cross sectional shape.

5. The electrical connector according to claim 1 wherein said mounting member is a threaded rod, the individual coils of said spring being received between threads on said rod to restrain said coils against axial movement along said flat surface.

* * * * *